United States Patent [19]

Cerniway et al.

[11] 4,067,064

[45] Jan. 10, 1978

[54] DIVING SUIT

[75] Inventors: Leon A. Cerniway, Mission Viejo; Bruce C. Marx, Fountain Valley, both of Calif.

[73] Assignee: U.S. Divers Co., Santa Ana, Calif.

[21] Appl. No.: 647,797

[22] Filed: Jan. 9, 1976

[51] Int. Cl.[2] ..... A62B 17/00; B63C 11/28

[52] U.S. Cl. ..... 2/2.1 R; 165/46; 112/419; 126/204

[58] Field of Search ..... 285/200 T, 201–215; 165/46; 2/2.1 R, 2.1 A; 128/379; 112/419; 126/204

[56] References Cited

U.S. PATENT DOCUMENTS

| | | | |
|---|---|---|---|
| 2,512,990 | 6/1950 | Akerman | 2/81 |
| 2,540,547 | 2/1951 | Rodert | 2/81 |
| 2,741,203 | 4/1960 | Rand | 112/419 |
| 3,348,236 | 10/1967 | Copeland | 2/81 |
| 3,391,405 | 7/1968 | Wisell, Jr. | 2/2.1 R |
| 3,449,761 | 6/1969 | Long | 2/2.1 R |
| 3,559,209 | 2/1971 | Vail | 2/2.1 A |
| 3,686,064 | 8/1972 | Bonnet et al. | 2/82 |

*Primary Examiner*—Carroll B. Dority, Jr.
*Assistant Examiner*—Theophil W. Streule, Jr.
*Attorney, Agent, or Firm*—George F. Bethel; Patience K. Bethel

[57] ABSTRACT

The following specification discloses a conformable elastomeric diving suit, known in the art as a wet suit. The suit includes conduits for delivering heated fluid, preferably water, to the diver at different portions along the diver's body by means of a conduit that has been formed as an elongated hollow member that can be stitched or adhered into the suit's seams. The conduits have openings that relate to those portions of the body to which hot water is to be delivered between the diver's skin and the interior of the wet suit. The conduits are extruded or made from plastic or elastomeric material that is stitched or adhered to seams within the wet wuit material, so as to provide one continuous seam or joining member in the seam, which serves to provide the hot water flow to the diver for heating purposes.

12 Claims, 7 Drawing Figures

DIVING SUIT

BACKGROUND OF THE INVENTION

1. Field of the Invention

The field of this invention lies within the diving suit art. More particularly, it lies in the diving suit art related to wet suits adapted for delivering heated water to the interfacing areas of a diver's body and the interior of the wet suit.

2. The Prior Art

The prior art related to heating wet suits with warm water comprises various means of delivering water into the wet suits. The patent art shows delivering hot water to wet suits with different valving, mixing, and delivery means. Some of the prior art shows the utilization of hot water conduits which run external to the suit, and deliver hot water to the extremeties of the limbs of a diver.

In addition thereto, the prior art shows water delivered to the diver by utilizing a conduit placed on the outside of the wet suit. Such conduits are provided with openings therein which mate with openings that are punched in the wet suit material. The openings of the conduit overly the outside of the wet suit and pass into the interior of the wet suit through the mated openings therein. Such configurations of outside conduits are cut in their cross section on a flat in order to allow a point of tangency between the outside of the wet suit and the conduit. This approach also incorporates increasingly sized holes along the conduit from one end to the other to allow for pressure drops as the fluid passes toward the extremeties of the user's limbs. In other words, the holes have been sized so that as they approach the extremeties of one's limbs, they increase in size. In this manner, the pressure drop from one end of the conduit to the other can be compensated for with regard to volumetric flow.

The drawback of all the prior art resides within the fact that the conduits are attached wholely within or without the wet suits. They are cumbersome and have not been flexibly mounted. Generally stated, the conduits are an afterthought in the manufacture of the wet suit and are merely an add-on feature. Such conduits have to be provided with openings and indexed to other spaced openings within the wet suit material, so as to provide for flow therethrough into the space between the user's body and the interior of the wet suit.

The foregoing prior art configurations create substantial drawbacks to the manufacture, use and function of heated water wet suits. To the contrary, this invention provides an integral conduit system for delivering heated water to a diver in a wet suit. The heated water principle hereof provides a continuous flow pattern of water to the diver, such that it allows for complete interfacial flow, eliminating cumbersome lines and conduits on the outside or inside of the suit.

In addition to the foregoing drawbacks of the prior art that are solved by this invention, the prior art problem related to hot spots has been solved. The invention avoids hot fluid flow being implaced directly against a diver's skin. It serves to provide greater uniformity of flow throughout the general interfacial area between the diver's skin and the wet suit.

In addition thereto, the prior art has a problem wherein the interfacing skin oftentimes covers the fluid openings. This retards flow between the skin of a diver and the inner surface of the wet suit. In other words, the plugging effect of the skin protruding or being layered against the openings prevents flow, creating incomplete warming.

This invention incorporates the concept of providing spaced delivery of fluid between the diver's skin and the wet suit material. This allows a warm surface layer of water to be delivered through the conduit to the area adjacent a diver's skin on a broader and larger surface area.

The foregoing features and advantages will be more apparent from the following specification as summarized in the summary of the invention hereinafter.

SUMMARY OF THE INVENTION

In summation, this invention comprises a series of conduits having ports therein. The conduits are integrated into a wet suit for delivering heated water to a diver at the interfacing area between the diver's skin and the inner surface of the wet suit.

More particularly, the invention incorporates a conduit which can be extruded or formed of a continuous hollow plastic material having a walled surface with openings therein. The walled surface can have openings that have been punched, formed, or molded in any particular manner. Each of the outer walls of the conduit are provided with flanges forming channels for receiving an edge region of a wet suit. The flanges or walls of the channels can be adhered to the wet suit in the seams by an adhesive or stitched to the wet suit material.

The conduits can be provided with increasingly sized openings therein enlarged from the area where initial delivery of hot fluid takes place to the extremeties, so as to allow for a pressure drop within the conduit. The conduits can be provided with spacing flanges or ledges at the interior surface thereof to allow for delivery of fluid from the conduit thereunder to the interfacial area between the diver's skin and the interior of the wet suit. The spacing flanges allow for free flow without extraordinary skin blockage from the conduits to the interfacial area, so that flow restrictions are not encountered.

As a consequence, this invention is a step over the prior art by providing an integral heated water conduit for a wet suit having improved delivery surfaces at the interfacial areas where the heated water is being delivered. The end product is also made with improved manufacturing techniques attendant therewith.

BRIEF DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
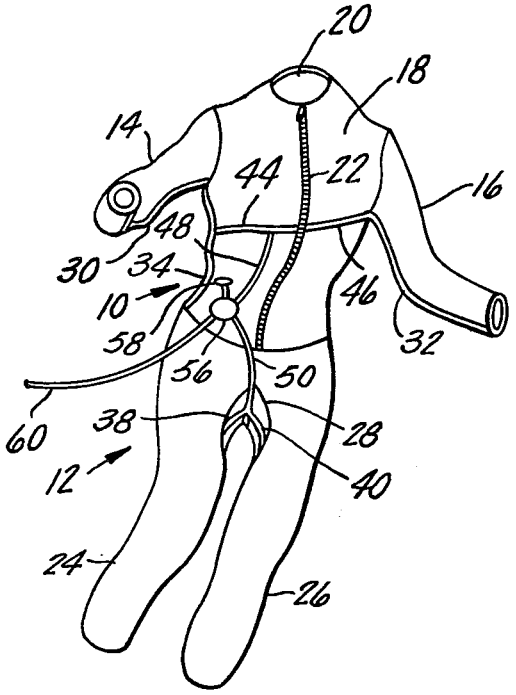
FIG. 1 shows a view of a wet suit in which the conduits of this invention are formed and fitted.

Looking more particularly at FIG. 1, a wet suit comprising an upper jacket 10 and a lower pair of pants 12 is shown. The upper jacket 10 has arms 14 and 16 with a thorax or body section 18. The jacket has a neck opening 20, as well as openings within the arms 14 and 16 for protrusion of the extremeties of a diver. The jacket has been provided with a zipper 22 to allow one to get in and out of it.

Looking more particularly at the pants 12, a pair of legs 24 and 26 are shown joined in the crotch section 28. The interior seams are shown for the respective arms 14 and 16, namely seams 30 and 32. A side seam 34 has been shown on the side of the body of the jacket and has also been incorporated on the other side which is not shown. Inner seams to the legs 38 and 40 are included in the respective leg portions 24 and 26.

All the foregoing seam areas are joined by the conduits of this invention to provide the heated water in the manner to be described. In particular, the seams 30, 38 and 40 are interconnected by a manifold system, including members 44 and 46 connected to a third conduit 48. The seams 38 and 40 are connected by another conduit 50 so that delivery of heated water or hot fluid can be provided to those respective seams.

The seams are held together by an interlaying area which is shown in the form of a conduit in FIGS. 2 through 7. The manifold conduit members 44, 46, 48, and 50 can also be made of the same conduits that shall be described in FIGS. 2 through 7. The conduits of FIGS. 2 through 7 can also be placed in any manner so as to provide for heated water in any location of the jacket 10.

The foregoing manifold members 44, 46, 48 and 50 have been connected to a distributing member 56 having a handle 58 attached thereto. The distributing member 56 and the handle 58 form a valve to allow for flow from a hose 60 that is connected to a source of heated water. The heated water source for the hose 60 can be at the surface in a tender or vessel having a hot water source such as a steam and water heat exchanger.

Figure 2:
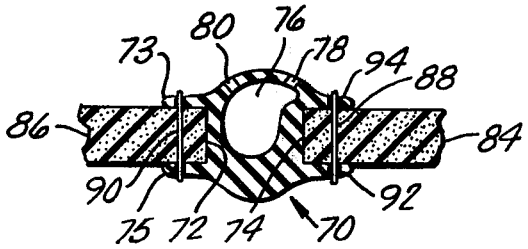
FIG. 2 shows a cross sectional view of a conduit of this invention stitched into abutting wet suit material.

Looking more particularly at the different embodiments, it can be seen in FIG. 2 that a hollow conduit 70 has been formed with channels 72 and 74 therein defined by upper and lower flanges 73 and 75. The conduit 70 can be extruded from a flexible elastomeric or plastic material, or a relatively resilient material that does not yield substantially, depending upon the amount of flexibility that a user desires. The conduit 70 has an opening 76 therethrough with openings 78 and 80 on either side of the top surface to allow water to flow outwardly against the skin of a user. The openings 78 and 80 can be increased in size along the length of the seams, so as to provide for uniform flow at the extremeties of a user's limbs due to attendant pressure drops from the point of connection.

In the embodiment shown in FIG. 2, the conduit 70 is stitched to the wet suit material forming a portion of the jacket 10 or trousers 12. The wet suit material has been shown as abutting members 84 and 86. The abutting members 84 and 86 can be stitched together by stitches 88 and 90. The stitches can be through the wet suit material and a number of prepositioned openings or holes within the flanges 73 and 75. In particular, openings 92 and 94 for example have been formed in the flanges 73 and 75 to accommodate the stitches 88 and 90.

The openings 92 and 94 that are implaced through either of the respective flanges 73 and 75, can be indexed to provide for stitching therethrough with respect to any particular stitching pattern. Furthermore, the flanges 73 and 75 can be thin enough so that stitching by a needle can pass through the flanges themselves without the indexed openings.

Figure 3:
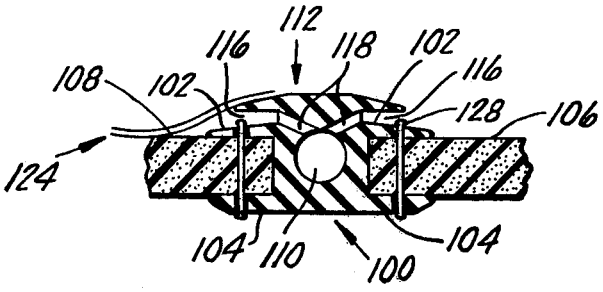
FIG. 3 shows an alternative conduit of this invention in cross section stitched into abutting wet suit material through the openings thereof.

Looking more particularly at FIG. 3, an alternative embodiment of a conduit 100 is shown. The conduit 100 has bilateral flanges 102 and 104 on either side which serve to secure wet suit material 106 and 108 in a channel provided between them. The conduit 100 has a passage 110 running therethrough and an overlying elongated bead or cap 112. The bead or cap 112 overlies the upper flanges 102 in spaced relationship, providing an elongated opening or channel 116. The channel 116 is connected to bilateral openings 118 so as to allow flow from the passage 110. In this manner, a user's skin designated 124 bridges the opening to prevent clogging or closure. The user's skin 124 shown bridging the opening allows unobstructed flow from the channel 116, thereby providing an unimpeded interfacial flow relationship.

The flanges 102 and 104 are respectively stitched by stitches 128 through the wet suit material 106. However, it should be understood that the stitches can be substituted as in the previous embodiment by an adhesive or heat setting of the wet suit material 106 between the flanges 102 and 104. The flanges 102 and 104 can be sufficiently thin to avoid the requirement of a preindexed opening so that stitching therethrough can be accommodated by a sewing machine stitching directly therethrough and through the wet suit material into the opposite flange.

Figure 4:
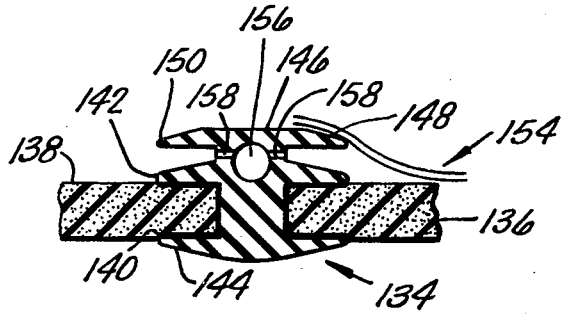
FIG. 4 shows an alternative conduit of this invention in cross section that has been adhered to the wet suit material by means of an adhesive.

Looking more particularly at FIG. 4, an alternative embodiment is shown comprising a conduit 134 which has wet suit material 136 and 138 adhered thereto by an adhesive 140. The conduit 134 has similar flanges to the previous embodiment at the edge regions, namely flanges 142 and 144 which provide a channel between them to receive the wet suit material 136 and 138 thereinto.

A continuous cap 146 is provided having extending flanges or ledges 148 and 150 similar to those of FIG. 3. The extending flanges or ledges 148 and 150 provide for spacing an interfacial skin area 154. This allows a flow of fluid in a passage 156 outwardly through bilaterally symmetrical openings 158 therein. The supported skin area 154 allows for the flow of fluid therethrough and prevents hot spots and a local concentration of fluid.

Figure 5:
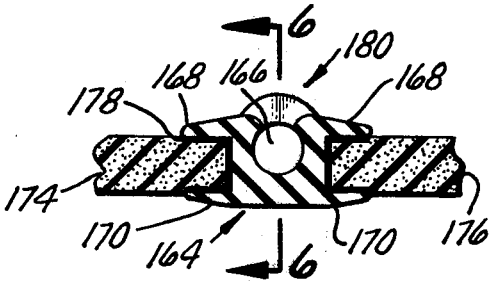
FIG. 5 shows a conduit of this invention in cross section that has been formed from a continuous extrusion and then cut across a top bead thereof, after which the material has been secured to abutting wet suit edges.
Figure 6:
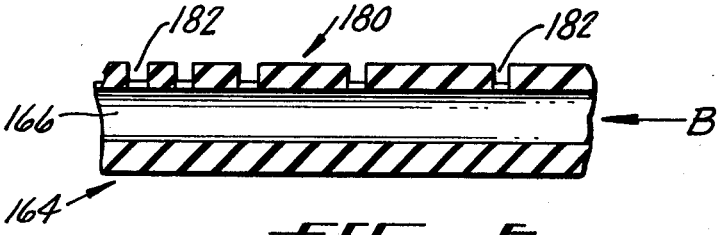
FIG. 6 shows a side elevation view thereof in the direction of lines 6—6 of FIG. 5; and, FIG. 7 shows an alternative embodiment of this invention in the same general form as FIG. 6.

The showing of FIG. 5 is of a conduit 164 having a passage 166 therethrough. The conduit 164 has flanges 168 and 170 on either side to form a pair of bilaterally symmetrical channels that receive a wet suit material 174 and 176 therein adhered by means of an adhesive 178. The wet suit material 174 and 176 is held therein by any suitable adhesive, or can be heat set or stitched as in the previous embodiments.

The conduit 164 has a protruding bead 180 which has been transversely sliced with openings 182. The openings 182 have been cut across the bead 180 to allow flow from the passage 166. The passage 166 allows flow to a greater extent progressively in the direction of arrow B as it proceeds along the conduit. In other words, flow in the direction of arrow B escapes progressively more readily than at the closer end, thus allowing pressure drops along the line to equalize the amount of flow from the conduit to the inner facing area between the skin and the wet suit. Also, it should be appreciated that the skin assumes somewhat of a bridging effect across the bead 180 to allow for greater flow.

Figure 7:
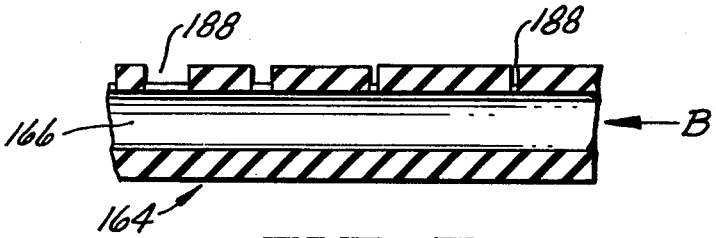

An alternative showing of FIG. 7 can be utilized wherein the conduit 164 having a passage 166 can be provided with slices 188 along the length thereof that increase in thickness from the direction of arrow B. Thus, less pressure is required as flow progresses from the initial introduction of fluid from the direction of arrow B. The larger sliced openings compensate for the decrease of pressure to allow uniform flow from the conduit 164 along its length.

The valve 56 and the handle 58 which introduce the flow of fluid into the conduit can be placed in any particular location. Also, the wet suit material of this invention can be formed of any material. However, in most cases, it is formed of an elastomeric foam, such as foam rubber. The foam rubber is generally backed by a fabric laminated or adhered thereto or heatset into the elastomeric compound.

From the foregoing, it can be deduced that this invention resides within the utilization of an integral conduit having a passage for delivery of heated water to a diver. The conduit can be placed within the seams or in any particular manner with abutting pieces of wet suit material affixed thereto. It can be formed of a continuously extruded piece of material and bonded by an adhesive or adhered in any suitable manner, as well as being stitched into the seams of the wet suit.

As a consequence, this invention should be read broadly in light of the following claims to provide conduits integrated into a wet suit.

We claim:

1. A conduit in combination with a wet suit formed therewith for delivering heated fluid such as water to a diver within the wet suit to provide warmth to the diver comprising:

a wet suit;

a main elongated conduit body having a passage therethrough adapted to be connected to a source of heated fluid;

means along each side of said main conduit body in the form of flanges for receiving wet suit material thereagainst so that the material can be joined by said conduit with said flanges to form said wet suit; and, openings within said conduit passing through the walls thereof in spaced relationship to each other adapted to be placed in proximate relationship to the skin on the interior surface of said wet suit so as to provide a flow of heated fluid to the diver.

2. The combination as claimed in claim 1 further comprising:

spaced flanges forming channels which form said wet suit receiving means on either side of said conduit for attaching wet suit material into said channels.

3. The combination as claimed in claim 2 further comprising:

openings through the conduit on either side of said main passage.

4. The combination as claimed in claim 1 wherein:

said flanges are sufficiently thin to allow penetration of a needle for stitching the wet suit material to said flanges.

5. The combination as claimed in claim 1 further comprising:

an elongated bead extending over said conduit; and, openings leading from said openings through said conduit outwardly under said bead wherein a diver's skin is not impressed directly against the openings through said conduit.

6. The combination as claimed in claim 1 further comprising:

a ledge implaced over the openings extending through said conduit.

7. The combination as claimed in claim 1 further comprising:

openings through said conduit varying in size increasingly toward the extremities of a diver in order to accommodate a pressure drop from the point of fluid introduction.

8. The combination as claimed in claim 1 further comprising:

an elongated protuberance extending above the conduit; and, transverse slices across said protuberance into the passage of said conduit for allowing the flow therefrom outwardly to the interfacing area between the skin and the interior surface of said wet suit.

9. A wet suit and a hot water delivery conduit within the seams of said wet suit comprising:

a conduit with a passage therethrough adapted for receiving hot water;

flange means defining a channel on either side of said conduit for receiving wet suit material of the seams therein;

means for securing wet suit material within said channels; and, openings connected to the passage through said conduit adapted to be placed adjacent to the interior side of said wet suit exposed to a diver's body.

10. The combination as claimed in claim 9 wherein said flanges are elongated to form said channels.

11. The combination as claimed in claim 9 further comprising:

openings within said flanges for receiving stitching therethrough for stitching the wet suit material inbetween the flanges.

12. The combination as claimed in claim 9 further comprising:

a ledge overlying the openings through said conduit in order to bridge any skin of a diver in adjacent relationship thereto across the ledge to provide for open passage from the openings.

* * * * *